US008555769B2

(12) United States Patent
Hubsch et al.

(10) Patent No.: US 8,555,769 B2
(45) Date of Patent: Oct. 15, 2013

(54) PROTECTION GRID FOR HATCH

(75) Inventors: Alain Hubsch, Roanne (FR); Daniel Baptista, Sorbiers (FR); Christian Prybilski, Saint-Etienne (FR); Bernard Denis, Saint-Priest-en-Jarez (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 13/556,852

(22) Filed: Jul. 24, 2012

(65) Prior Publication Data

US 2013/0025443 A1 Jan. 31, 2013

(30) Foreign Application Priority Data

Jul. 29, 2011 (FR) ..... 11 02396

(51) Int. Cl.
*F41H 5/00* (2006.01)
*F41H 7/02* (2006.01)

(52) U.S. Cl.
USPC ..... 89/36.08; 89/36.02; 89/918; 89/937

(58) Field of Classification Search
USPC ..... 89/36.02, 36.01, 36.04, 36.07–36.09, 89/36.11, 36.12, 918, 930, 937, 920; 109/15, 49.5, 58, 58.5, 59 R, 60, 64, 65, 109/74
See application file for complete search history.

(56) References Cited

U.S. PATENT DOCUMENTS 7,882,776 B2 * 2/2011 Medwell et al. ..... 89/36.02
7,975,594 B2 * 7/2011 Wartmann ..... 89/36.02
8,011,285 B2 * 9/2011 Farinella et al. ..... 89/36.08
8,042,449 B2 * 10/2011 Farinella et al. ..... 89/36.01
8,141,470 B1 * 3/2012 Farinella et al. ..... 89/36.01
8,245,620 B2 * 8/2012 Farinella et al. ..... 89/36.08
8,245,621 B2 * 8/2012 Farinella et al. ..... 89/36.08
8,245,622 B2 * 8/2012 Farinella et al. ..... 89/36.08
8,402,878 B2 * 3/2013 Schreiner et al. ..... 89/36.08
8,443,709 B2 * 5/2013 Farinella et al. ..... 89/36.08

(Continued)

FOREIGN PATENT DOCUMENTS

EP 1 944 566 A1 7/2008
WO WO 2009/064263 A2 5/2009

OTHER PUBLICATIONS

"Warthog unveiled", Internet Citation, Sep. 20, 2009, pp. 1-5, XP002656365, http://www.youtube.com/watch?v=26-oa-EPnFs [retrieved on Sep. 20, 2009].

(Continued)

*Primary Examiner* — Jonathan C Weber
(74) *Attorney, Agent, or Firm* — Oliff & Berridge, PLC

(57) ABSTRACT

An offset ballistic protection device protecting a wall provided with a hatch (200), wherein said device comprises at least a first grid (1) offset with respect to the wall and comprising a first series of bars (1*a*) parallel to each other and substantially perpendicular to the pivot axis (400) of a hinge (300) of the hatch (200). This ballistic protection device (101) comprises a second grid (2) offset with respect to the hatch (200) and comprising a second series of bars (2*a*) substantially parallel to the first series of bars (1*a*), wherein the second grid (2) is positioned with respect to the first grid (1) so that the bars (2*a*) thereof are spatially offset in the plane of the second grid (2) with respect to the bars (1*a*) of the first grid (1), wherein the bars (2*a*) of the second grid (2) are therefore able to pass between the bars (1*a*) of the first grid (1) during pivoting of the leaf (200).

10 Claims, 4 Drawing Sheets

(56) References Cited

U.S. PATENT DOCUMENTS

| | | | | |
|---|---|---|---|---|
| 8,453,552 | B2 * | 6/2013 | Farinella et al. | 89/36.08 |
| 8,464,627 | B2 * | 6/2013 | Farinella et al. | 89/36.08 |
| 8,468,927 | B2 * | 6/2013 | Malone et al. | 89/36.08 |
| 2008/0257141 | A1 * | 10/2008 | Medwell et al. | 89/36.02 |
| 2009/0266226 | A1 * | 10/2009 | Beach et al. | 89/36.02 |
| 2009/0266227 | A1 * | 10/2009 | Farinella et al. | 89/36.02 |
| 2011/0079135 | A1 * | 4/2011 | Farinella et al. | 89/36.02 |
| 2011/0113952 | A1 * | 5/2011 | Rosenwasser et al. | 89/36.02 |
| 2011/0179944 | A1 * | 7/2011 | Farinella et al. | 89/36.02 |
| 2011/0203453 | A1 * | 8/2011 | Farinella et al. | 89/36.02 |
| 2011/0232472 | A1 * | 9/2011 | Kellner et al. | 89/36.08 |
| 2012/0011993 | A1 * | 1/2012 | Malone et al. | 89/36.02 |
| 2012/0060677 | A1 * | 3/2012 | Farinella et al. | 89/36.02 |
| 2012/0067199 | A1 * | 3/2012 | Farinella et al. | 89/36.02 |
| 2012/0137866 | A1 * | 6/2012 | Gonard et al. | 89/36.08 |
| 2012/0144986 | A1 * | 6/2012 | Gonard et al. | 89/36.01 |
| 2012/0152101 | A1 * | 6/2012 | Engleman et al. | 89/36.08 |
| 2012/0180639 | A1 * | 7/2012 | Farinella et al. | 89/36.08 |
| 2012/0180640 | A1 * | 7/2012 | Farinella et al. | 89/36.08 |
| 2012/0247316 | A1 * | 10/2012 | Farinella et al. | 89/36.02 |
| 2012/0255431 | A1 * | 10/2012 | Hubsch | 89/36.08 |
| 2013/0032026 | A1 * | 2/2013 | Shackelford et al. | 89/36.02 |

OTHER PUBLICATIONS

"Warthog ATV All-terrain vehicle", Internet Citation, Jun. 24, 2010, p. 1, XP002656366, http://4.bp.blogspot.com/-iWfK3PUKctM/TfJeuBBwKrI/AAAAAAAAIBU/DzMcFsCOf2E/s1600/warthog_with_slat_armor_atv_all_terrain_vehicle_uk_british_armed_forces_03.jpg [retrieved on Jun. 24, 2010].

Ogorkiewicz, R M, "Rocket science: vehicle armour evolves protection against RPG attacks," *Jane's International Defence Review*, Sep. 1, 2010, pp. 33-35, vol. 43, September issue, XP001570142, ISSN: 1476-2129, Surrey, Great Britain.

Mar. 5, 2012 French Search Report issued in Application No. FR1102396 (with translation).

Mar. 5, 2012 Written Opinion issued in Application No. FR1102396 (with translation).

* cited by examiner

PROTECTION GRID FOR HATCH

CROSS REFERENCE TO RELATED APPLICATIONS

Applicant claims priority under 35 U.S.C. 119 of French patent application no. 1102396 filed on 29 Jul. 2011.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention belongs to the technical field of ballistic protection grids for military vehicles.

2. Description of the Related Art

To protect the military vehicles from rocket attacks, it is known to place protection grids on the perimeter of the vehicle and at a distance from the outer walls of the vehicle.

The function of these grids is to deteriorate the warhead of a possible projectile fired against the vehicle. Placing the grid at a distance from the wall ensures good operation of the protection device. However, for accessing or disembarking the vehicle, the conventional use of the door- or trap door-type hatches is hampered by the presence of the protection grids placed in front of these hatches.

A solution described in EP1944566 is to organize the grids into separate panels, wherein each panel is connected to the adjacent panel by a hinge for folding the protection device in order to reach the door. Handling such a device is long and complex when one has to open or close the hatch and the grid from the inside of the vehicle for example.

This device requires one to close in two steps with the help of a third person located outside the vehicle.

The invention proposes to solve said complexity problem of opening by a single person while ensuring retention of an optimum ballistic protection at the hatch.

BRIEF SUMMARY OF THE INVENTION

The subject-matter of the invention is an offset ballistic protection device protecting a wall provided with a hatch, wherein said device comprises:

at least a first grid offset with respect to the wall and connected thereto, wherein the first grid comprises a first series of bars parallel to each other, wherein a first end of the first series of bars is in the vicinity of a hinge of the hatch, wherein the first series of bars is substantially perpendicular to the pivot axis of the hinge, a second grid offset with respect to the hatch and connected thereto, wherein the second grid comprises a second series of bars substantially parallel to the first series of bars, wherein the second grid is positioned with respect to the first grid so that the bars of the second grid are spatially offset in the plane of the second grid with respect to the bars of the first grid, wherein the bars of the second grid are therefore able to pass between the bars of the first grid during pivoting of the hatch.

According to one feature of the invention, the first and second grids are placed in two parallel planes when the hatch is closed.

Advantageously, the outer face of the first grid is substantially in the same plane as the inner face of the second grid.

According to another feature of the invention, the first grid is provided with at least one rigid edge provided in the vicinity of the axis of the hinge of the hatch, wherein said rigid edge is connected to the first ends of the first series of bars, wherein each of the first ends of the bars of the second grid is further provided with a shim connected to at least one post, wherein the shims have a thickness such that when the second grid is closed the outer face of the first grid is in the same plane as the inner face of the second grid and the post is located opposite the inner face of the first grid.

Advantageously, the post and the rigid edge are substantially parallel and placed in the vicinity of the hinge of the hatch.

Advantageously, the second grid is positioned with respect to the first grid so that the bars thereof are neighboring the bars of the first grid.

BRIEF DESCRIPTION OF THE SEVERAL VIEWS OF THE DRAWING

The invention will be better understood from the following description, with reference to the appended drawings in which.

DETAILED DESCRIPTION OF THE INVENTION

Figure 1:
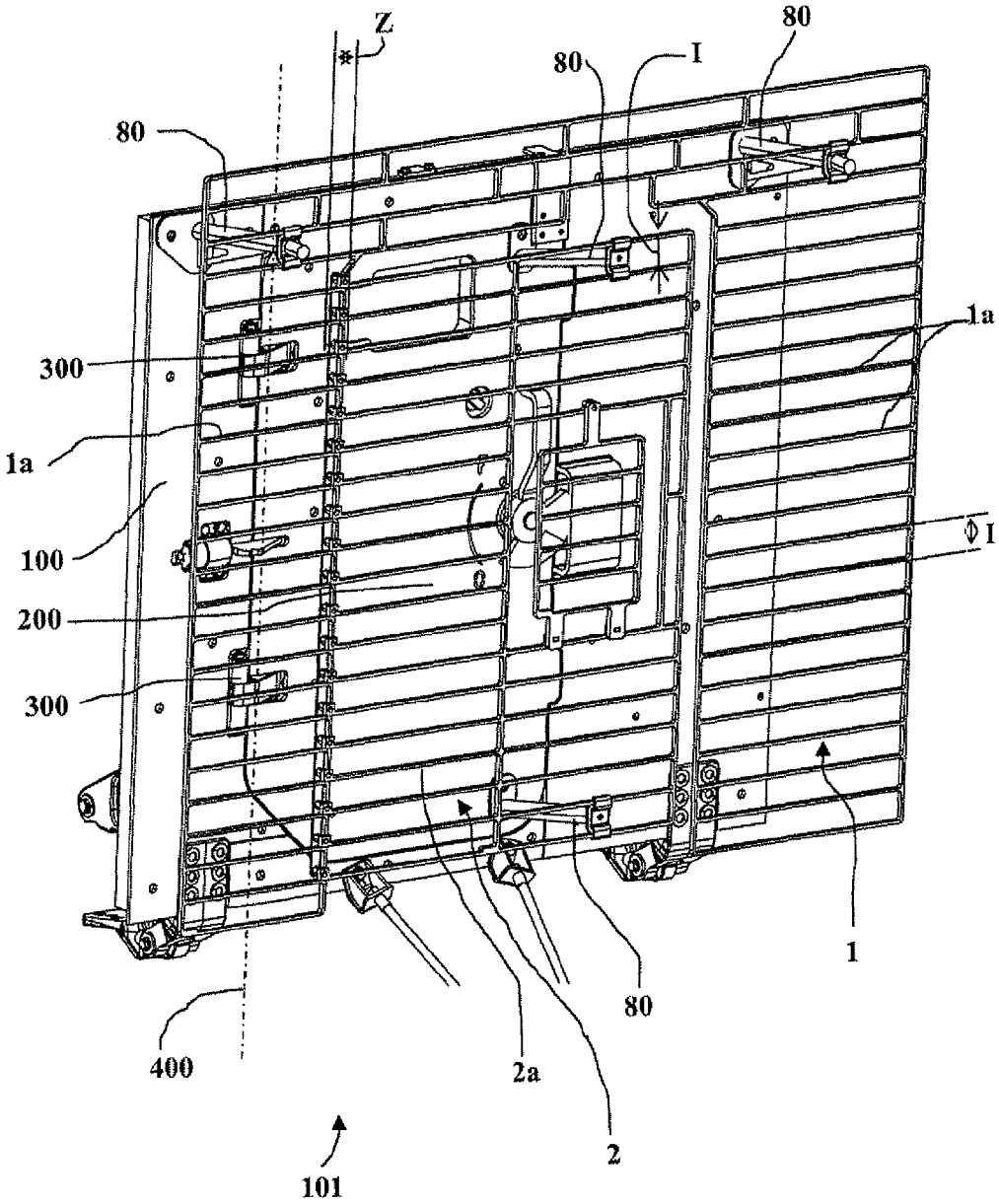
FIG. 1 depicts a partial perspective view of a military vehicle wall with a closed hatch, wherein the assembly is protected by a device according to the invention.

According to FIG. 1 and according to one embodiment, an outer wall 100 of an armored military vehicle (vehicle not shown) is provided with a door constituting a hatch 200 for disembarking or boarding the vehicle. The hatch 200 is hinged with respect to the wall 100 via two hinges 300 of substantially vertical axis 400. The wall 100 and hatch 200 are protected from the attacks of shaped charge rockets by a protection device 101 according to the invention.

This device comprises a fixed first protection grid 1 connected to the wall 100 and placed at a distance therefrom (distance of approximately 300 mm) via attachment arms 80. The device 101 also comprises a second grid 2 connected to the hatch 200 and placed at a distance therefrom via other attachment arms 80. The second grid 2 covers at least the entire surface of the hatch 200. Each of the two grids 1 and 2 comprises a series of bars 1*a* and 2*a* all parallel to each other, wherein the bars of the first grid 1 are in addition parallel to the bars of the second grid 2. Also, the inter-bar gap I is identical for both grids 1 and 2.

Figure 4:
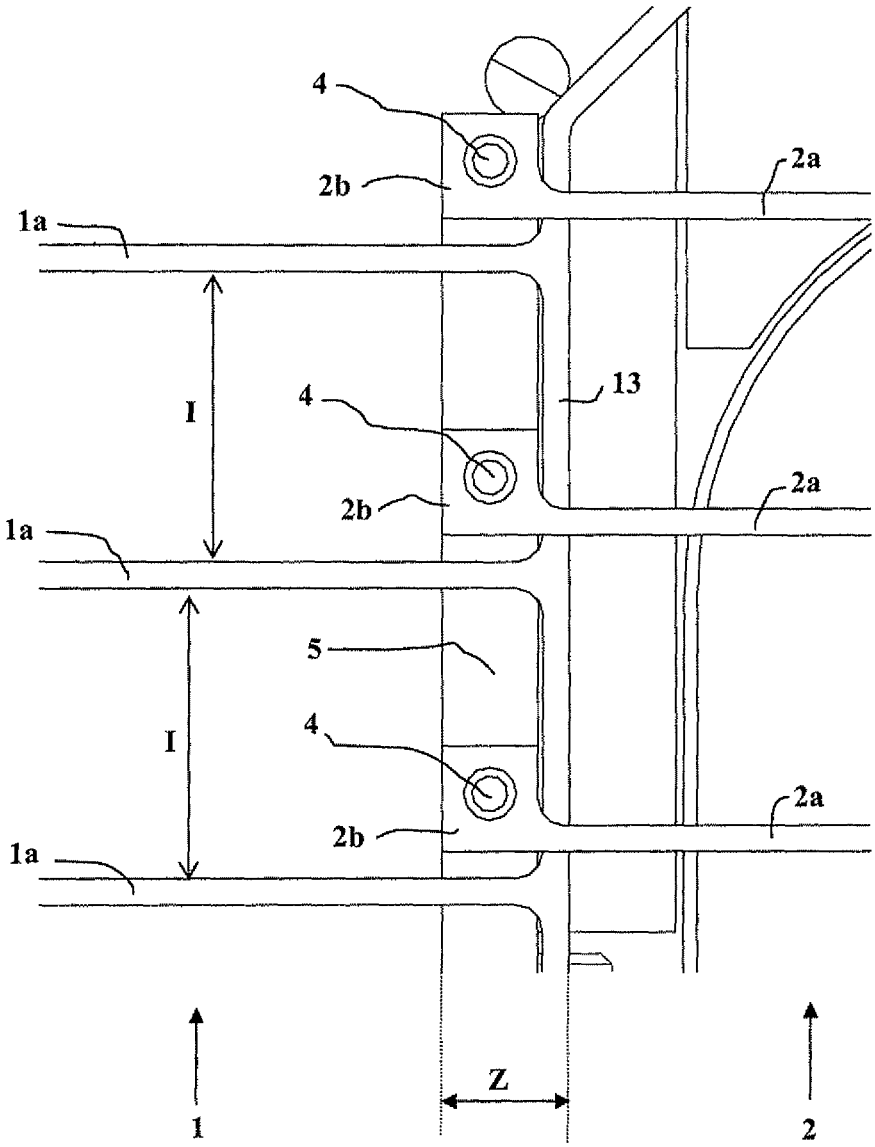
FIG. 4 depicts a partial external view specifying the relative location of the grids in a closed position.

All bars 1*a* and 2*a* are substantially perpendicular to the axis 400. It will be noted that the second series of bars 2*a* is spatially offset in the plane of the second grid 2 with respect to the first series so that the bars 1*a* of the first series and the bars 2*a* of the second series are not collinear with each other. The bars 2*a* of the second grid 2 are therefore able to pass between the bars 1*a* of the first grid 1 during pivoting of the hatch 200. Referring to FIG. 4, it will be noted that, when projecting a plane of a grid in the plane of the other, the bars of each of the grids are alternately placed between each other at their neighboring ends.

According to this embodiment, both grids 1 and 2 show a common cover zone Z of the wall 100. It will be noted that according to this embodiment, when the hatch 200 is closed, the second grid 2 is not in the plane of the first grid 1.

Figure 2:
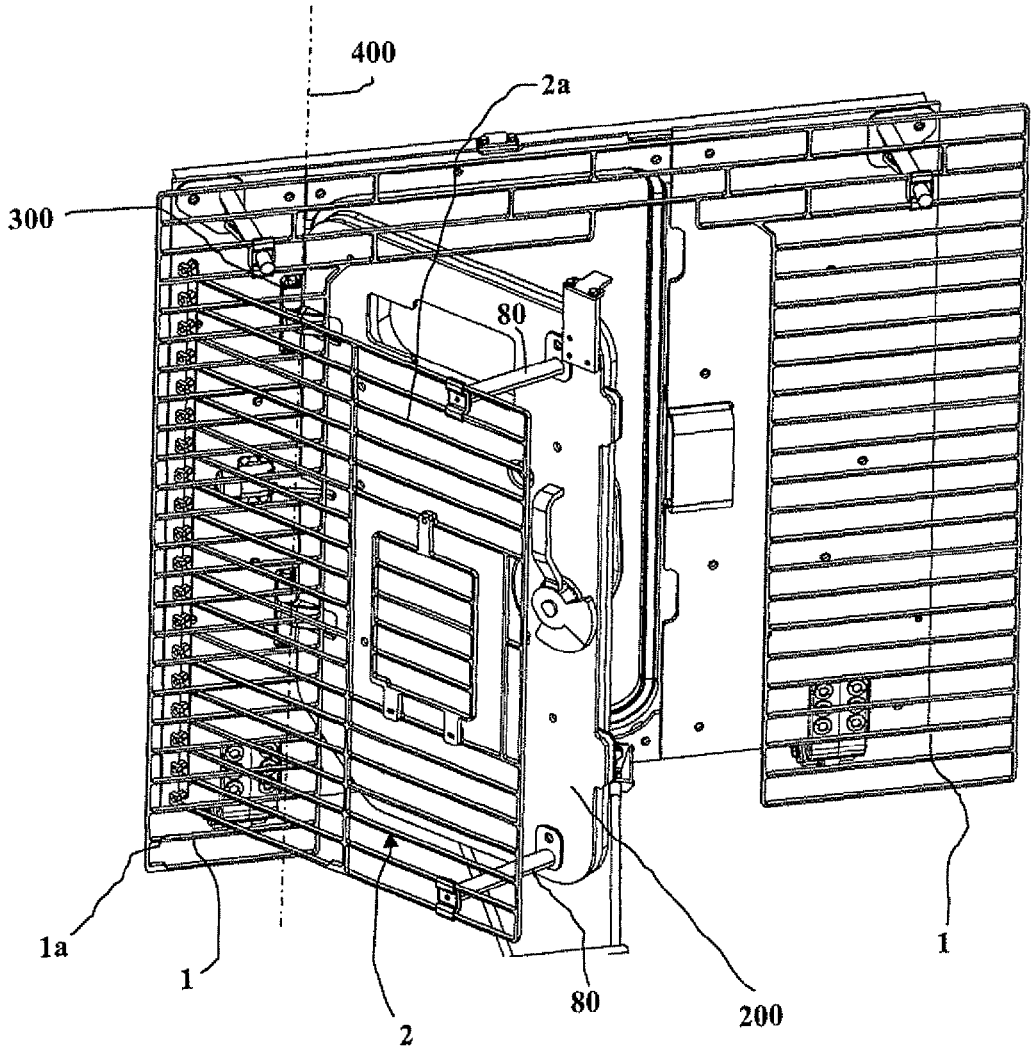
FIG. 2 depicts a partial perspective view of said military vehicle wall with the hatch partially open, wherein the assembly is protected by a device according to the invention.

FIG. 2 shows the same protection device 101 with the hatch 200 partially open. It will be noted that the bars of each of the grids are alternately placed between each other at their ends neighboring the axis 400 of hinge 300. Since the second grid 2 is in addition movable together with the hatch 200, the two grids do not interfere with each other during the opening movement of the hatch 200. The bars 2*a* of the second grid 2 are indeed free to move between the bars 1*a* of the first grid 1.

Figure 3:
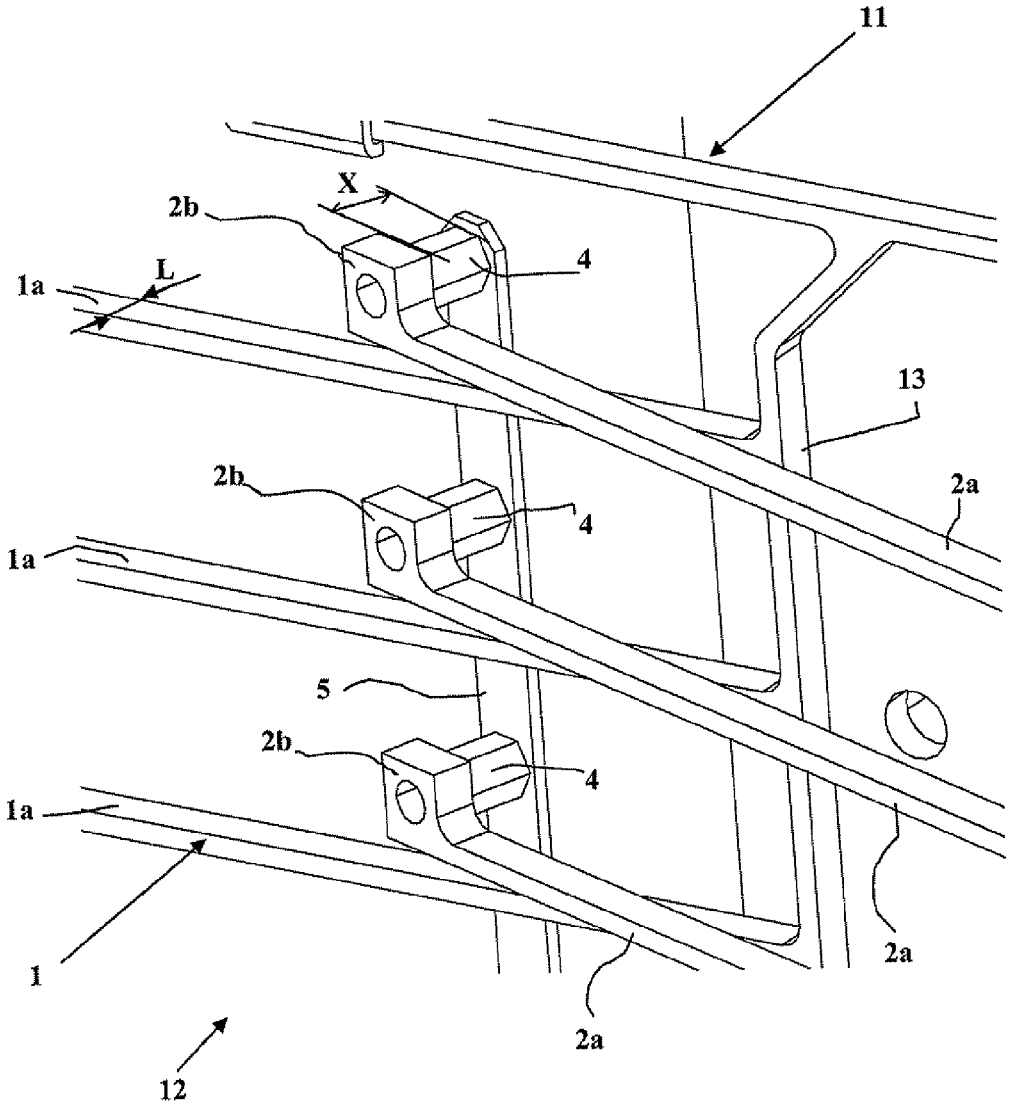
FIG. 3 depicts a partial perspective view of the grids with the hatch partially open.

The relative positioning of the bars 1*a* and 2*a* of the grids 1 and 2 is more particularly visible in FIGS. 3 and 4. The second grid 2 is provided at the ends of each of the bars 2*a* thereof with a shim 4. Each of the shims 4 connects to the end 2*b* of each bar 2*a* to a post 5. The post 5 is placed on the inner face 11 side of the first grid 1 while the second grid 2 is placed on the outer face 12 side of the first grid 1 when the hatch is closed (see FIG. 4 in particular).

Each shim 4 has a length X greater than the width L of the bars 1*a* of the first grid 1. The first grid 1 is provided with an edge 13 in the vicinity of the axis 400, wherein said edge is connected to the ends of the bars 1*a* of the first grid 1 and is perpendicular thereto.

The edge 13 and the post 5 are parallel to each other and rigidify the grids 1 and 2. Their presence forces the grids 1 and 2 to be in parallel planes when the hatch 200 is closed. Said presence of the edge 13 and post 5 also requires there be an overlapping zone Z between the grids 1 and 2. In fact, closing the hatch 200 causes a movement of the post 5 towards the edge 13. The width of the overlapping zone Z is selected so that the hatch may be closed completely without mechanical interferences between the post 5 and the edge 13 (see FIG. 4).

It will be noted that to enable pivoting of the second grid 2 with respect to the first grid 1, the bars 1*a* and 2*a* of each grid are not aligned (as has been previously described in the text).

The second grid 2 is positioned with respect to the first grid 1 so that the bars 2*a* thereof are neighboring the bars 1*a* of the first grid 1. Interferring of the shims 4 placed at the ends of the second bars 2*a* of the second grid 2 with the first bars 1*a* of the first grid 1 is therefore prevented.

Alternatively, it is possible to define grids 1 and 2 not provided with an edge 13 or post 5. Such an arrangement suppresses all risks of mechanical interferences between the grids 1 and 2 when opening and closing the hatch 200. It is then possible to position the first grid 1 and the second grid 2 substantially in the same plane.

What is claimed is:

1. An offset ballistic protection device (101) protecting a wall (100) provided with a hatch (200), wherein said device (101) comprises:

at least a first grid (1) offset with respect to the wall (100) and connected thereto, wherein the first grid (1) comprises a first series of bars (1*a*) parallel to each other, wherein a first end of the first series of bars (1*a*) is in the vicinity of a hinge (300) of the hatch (200), wherein the first series of bars (1*a*) is substantially perpendicular to the pivot axis (400) of the hinge (300), a second grid (2) offset with respect to the hatch (200) and connected thereto, wherein the second grid (2) comprises a second series of bars (2*a*) substantially parallel to the first series of bars (1*a*), wherein the second grid (2) is positioned with respect to the first grid (1) so that the bars (2*a*) of the second grid (2) are spatially offset in the plane of the second grid (2) with respect to the bars (1*a*) of the first grid, wherein the bars (2*a*) of the second grid (2) are therefore able to pass between the bars (1*a*) of the first grid (1) during pivoting of the hatch (200).

2. The offset ballistic protection device (101) of claim 1, wherein the first and second grids (1 and 2) are placed in two parallel planes when the hatch (200) is closed.

3. The offset ballistic protection device (101) of claim 2, wherein the outer face (12) of the first grid (1) is substantially in the same plane as the inner face (11) of the second grid (2).

4. The offset ballistic protection device (101) of claim 2, wherein the second grid (2) is positioned with respect to the first grid (1) so that the bars (2*a*) thereof are neighboring the bars (1*a*) of the first grid (1).

5. The offset ballistic protection device (101) of claim 3, wherein the first grid (1) is provided with at least one rigid edge (13) provided in the vicinity of the axis (400) of the hinge (300) of the hatch (200), wherein said rigid edge (13) is connected to the first ends of the first series of bars (1*a*), wherein each of the first ends of bars (2*a*) of the second grid (2) is further provided with a shim (4) connected to at least one post (5), wherein the shims (4) have a thickness such that when the second grid (2) is closed the outer face (12) of the first grid (1) is in the same plane as the inner face of the second grid (2) and the post (5) is located opposite the inner face (11) of the first grid (1).

6. The offset ballistic protection device (101) of claim 3, wherein the second grid (2) is positioned with respect to the first grid (1) so that the bars (2*a*) thereof are neighboring the bars (1*a*) of the first grid (1).

7. The offset ballistic protection device (101) of claim 5, wherein the post (5) and the rigid edge (13) are substantially parallel and placed in the vicinity of the hinge (300) of the hatch (200).

8. The offset ballistic protection device (101) of claim 5, wherein the second grid (2) is positioned with respect to the first grid (1) so that the bars (2*a*) thereof are neighboring the bars (1*a*) of the first grid (1).

9. The offset ballistic protection device (101) of claim 7, wherein the second grid (2) is positioned with respect to the first grid (1) so that the bars (2*a*) thereof are neighboring the bars (1*a*) of the first grid (1).

10. The offset ballistic protection device (101) of claim 1, wherein the second grid (2) is positioned with respect to the first grid (1) so that the bars (2*a*) thereof are neighboring the bars (1*a*) of the first grid (1).

* * * * *